US005228982A

United States Patent [19]

Scouten et al.

[11] Patent Number: 5,228,982

[45] Date of Patent: Jul. 20, 1993

[54] LIQUEFACTION OF DECARBOXYLATED CARBONACEOUS SOLIDS

[75] Inventors: Charles G. Scouten, Warrenville; Arunabha Basu; Joseph T. Joseph, both of Naperville, all of Ill.

[73] Assignee: Amoco Corporation, Chicago, Ill.

[21] Appl. No.: 689,192

[22] Filed: Apr. 22, 1991

[51] Int. Cl.[5] ..... C10G 1/00; C10G 1/06; C10G 1/08

[52] U.S. Cl. ..... 208/400; 208/415; 208/418; 208/419; 208/426; 208/428

[58] Field of Search ..... 208/415, 418, 419, 426, 208/428

[56] References Cited

U.S. PATENT DOCUMENTS

| | | | |
|---|---|---|---|
| 3,791,956 | 2/1974 | Gorin et al. | 208/418 |
| 4,094,765 | 6/1978 | Bearden, Jr. et al. | 208/951 |
| 4,149,959 | 4/1979 | Bearden, Jr. et al. | 208/951 |
| 4,161,440 | 7/1979 | Brunson | 208/951 |
| 4,304,655 | 12/1981 | Poddar | 208/951 |
| 4,332,668 | 6/1982 | Brunson | 208/430 |
| 4,617,106 | 10/1986 | Garg | 208/418 |
| 4,618,735 | 10/1986 | Bridle et al. | 208/13 |

FOREIGN PATENT DOCUMENTS

| | | | |
|---|---|---|---|
| 0050991 | 5/1981 | Japan | 208/419 |

*Primary Examiner*—Theodore Morris
*Assistant Examiner*—P. L. Hailey
*Attorney, Agent, or Firm*—Scott P. McDonald; Richard A. Kretchmer; Frank J. Sroka

[57] ABSTRACT

A composition consisting essentially of a carbonaceous solid containing at least one carboxyl group is heated with subcritical liquid water at decarboxylation conditions including a temperature of at least about 300° F. to substantially decarboxylate the solid, thereby producing a stream comprising a decarboxylated solid and water. The water is separated from the decarboxylated solid prior to liquefying the solid.

27 Claims, 1 Drawing Sheet

LIQUEFACTION OF DECARBOXYLATED CARBONACEOUS SOLIDS

FIELD OF THE INVENTION

This invention relates to a liquefaction process comprising the steps of heating a composition consisting essentially of a carbonaceous solid containing at least one carboxyl group with subcritical liquid water at decarboxylation conditions including a temperature of at least about 300° F. to substantially decarboxylate said solid, thereby producing a stream comprising a decarboxylated carbonaceous solid and water; separating a substantial portion of said water from said decarboxylated carbonaceous solid; and liquefying said decarboxylated carbonaceous solid to produce a hydrocarbon-containing liquid.

BACKGROUND OF THE INVENTION

Low-rank coals, including sub-bituminous coals, brown coals, lignites, peats and other humic solids, represent one of the largest fossil fuel resources in the world. Most of the low-rank coal deposits are located near the earth's surface, and can be mined at significantly lower cost than typical bituminous coals. In addition, many low-rank coals have a very low sulfur content, relative to bituminous coals. As a result, low-rank coals are emerging as preferred feedstocks for coal liquefaction.

However, low-rank coals present special problems in coal liquefaction. Low-rank coals are richer in oxygen than bituminous coals. Most of the additional oxygen is present as carboxylic acids and their salts. These carboxyl groups contribute to several important problems in liquefaction of coal. First, they bind water strongly, making drying low-rank coals difficult and costly. The bound water not removed by drying is liberated during coal liquefaction, thereby lowering hydrogen partial pressures and accelerating catalyst deactivation. Second, metals bound as the salts of these carboxylic acids are not effectively removed by conventional coal cleaning methods, and therefore can be liberated during liquefaction. This can result in the need for a de-asher to reduce high ash load. Moreover, once liberated, these metals can attack and deactivate the supported catalysts typically used to promote liquefaction of the coal. Third, carboxylic acids and their salts can undergo retrograde reactions, for example ketone formation, that make coal harder to liquefy. These retrograde reactions are especially troublesome when the coal contains appreciable amounts of calcium and magnesium. Finally, carboxylic acids and their salts can decarboxylate during coal liquefaction liberating carbon dioxide. In hydroliquefaction, this liberated carbon dioxide lowers the hydrogen partial pressure and requires scrubbing to maintain the desired purity of the recycle hydrogen stream.

Pretreatment of low-rank coals prior to liquefaction is well known in the industry. Most of these pretreatment processes are designed to address the problem of how to handle alkaline earth metals, particularly calcium, which are contained in the coal. These metals can react with available anions during liquefaction to form solid scale particles which deposit in the liquefaction reactor, thereby reducing reactor volume, liquefaction time, and total throughput. Moreover, a portion of the scale can remain in the liquid product and result in downstream plugging.

It has been discovered that alkaline earth metal deposits, which form during liquefaction of low-rank coal, can be avoided by converting these metals to a salt which will remain stable during liquefaction. For example, U.S. Pat. No. 4,332,668 discloses pretreating low-rank coal prior to liquefaction by contacting the coal with phthalic acid, phthalic anhydride, pyromellitic acid, or pyromellitic anhydride to convert the scale-forming components to the corresponding phthalate or pyromellitate prior to liquefaction. It is believed that the majority of the alkaline earth metals in the coal is converted into an insoluble, thermally stable alkaline earth metal phthalate which remains within the coal and is released during liquefaction as particulate solids which are recovered with the liquefaction bottoms.

Another coal pretreatment process for handling scale formation that occurs during liquefaction of low-rank coal is contacting the coal with a sulfur-containing compound prior to liquefaction. When the sulfur-containing compound is an oxide of sulfur, the addition of the sulfur dioxide or sulfur trioxide is believed to form an anion which combines with the alkaline earth metal to form a molecular species which precipitates within the pore as an insoluble molecular sulfate of the alkaline earth metal. An example of such a process is U.S. Pat. No. 4,304,655 which discloses contacting low-rank coal with a combination of pretreating agents comprising sulfur dioxide and an oxidizing agent. Another example is U.S. Pat. No. 4,161,440 which contacts a low-rank coal with an oxide of sulfur, in liquid phase. U.S. Pat. Nos. 4,149,959 and 4,094,765 contact coal with a $H_2S$ gas prior to coal liquefaction.

Another way of addressing the scale formation problems associated with low-rank coals is to pretreat the coal by contacting it with a carbon dioxide-containing gas. It is believed that this process converts the alkaline earth metal to its corresponding carbonate which remains with the coal during liquefaction and, therefore, does not form scale. An example of such a process is U.S. Pat. No. 4,206,033 wherein a low-rank coal is contacted with carbon dioxide at a partial pressure above one atmosphere prior to coal liquefaction. Another example of a carbon dioxide pretreatment process can be found in U.S. Pat. No. 4,714,543.

U.S. Pat. No., 4,450,066 handles the problem of scale formation during liquefaction by hydrothermal pretreatment prior to liquefaction. It is believed that carbon dioxide is released during the hydrothermal treatment. The liberated carbon dioxide is then absorbed by the water, which is effectively retained in the coal pores by a hydrocarbon solvent and elevated pressure, and reacts with liberated alkaline earth metal to form the corresponding alkaline earth metal carbonate. These metal carbonates are not separated from the coal. Rather, they remain with the coal during liquefaction, where they can adversely affect coal conversion and product quality and can deactivate the catalysts used to promote liquefaction and product upgrading.

The above-described methods of pretreating low-rank coal can ameliorate scale problems in liquefaction. However, these methods do not remove the alkali and alkali earth metals from the coal during liquefaction. These metals can deactivate catalysts, and can adversely affect coal conversion and product quality.

U.S. Pat. No. 4,579,562 discloses decarboxylating low-rank coal by contacting the coal with water at a temperature of about 400°-650° F. and at a pressure sufficient to prevent boiling of the water prior to combusting the coal. This process makes the coal easier to dry, increases heating value, and makes it more economical to transport. Nowhere in this patent is there disclosed or suggested liquefying the decarboxylated coal.

European Patent No. 264,743 discloses contacting an aqueous suspension of coal with carbon monoxide in the presence of a hydroxide or an alkali metal carbonate at a temperature of about 662°-809° F. for about 5-60 minutes. Although this process can be effective at removing undesirable carboxylic acids, the carbon monoxide can react with the water to form hydrogen and carbon dioxide. The presence of carbon dioxide during liquefaction can lower hydrogen partial pressure, thereby decreasing coal liquefaction. Moreover, the presence of hydrogen can undesirably retard decarboxylation.

SUMMARY OF THE INVENTION

In its broadest aspect, the present invention is a liquefaction process comprising the steps of heating a composition consisting essentially of a carbonaceous solid containing at least one carboxyl group with subcritical liquid water at decarboxylation conditions including a temperature of at least about 300° F. to substantially decarboxylate said solid, thereby producing a stream comprising a decarboxylated carbonaceous solid and water; separating a substantial portion of said water from said decarboxylated carbonaceous solid; and liquefying said decarboxylated carbonaceous solid to produce a hydrocarbon-containing liquid. Substantial decarboxylation of the carbonaceous solid in the absence of an added hydrogen source prior to liquefaction can significantly improve hydrocarbon-containing liquid yields by removing organically bound metals that can retard liquefaction and can deactivate liquefaction catalysts, if present.

In another embodiment, the present invention is a coal hydroliquefaction process comprising the steps of heating a composition consisting essentially of coal containing at least one carboxyl group with subcritical liquid water at decarboxylation conditions including a temperature of at least about 300° F. to substantially decarboxylate said coal, thereby producing a stream comprising decarboxylated coal and water; agglomerating said stream by contacting said stream with an organic liquid to form a two-phase mixture comprising an organic phase comprising solid coal agglomerates and a mineral-rich aqueous phase; and separating said organic phase from said aqueous phase, thereby producing a decarboxylated, demineralized coal; and hydroliquefying said decarboxylated, demineralized coal to produce a coal-derived liquid. Oil agglomerating decarboxylated coal prior to hydroliquefaction is an effective way of removing undesirable mineral matter from the coal because decarboxylated coal is more hydrophobic than raw coal. Consequently, the mineral removal efficiency of oil agglomeration is higher than other beneficiation methods.

In another embodiment, the present invention is a coal agglomeration process comprising the steps of heating a composition consisting essentially of a low-rank coal containing at least one carboxyl group with subcritical liquid water at decarboxylation conditions including a temperature of at least about 300° F. in the presence of a copper catalyst to substantially decarboxylate said coal, thereby producing a stream comprising decarboxylated coal and water; agglomerating said stream by contacting said stream with an organic liquid to form a two-phase mixture comprising an organic phase comprising solid coal agglomerates and a mineral-rich aqueous phase; separating said organic phase from said aqueous phase, thereby producing a decarboxylated, demineralized coal; hydroliquefying said decarboxylated, demineralized coal to produce coal-derived liquid; and recycling at least a portion of said coal-derived liquid to the agglomeration step.

DESCRIPTION OF THE PREFERRED EMBODIMENT

Figure 1:
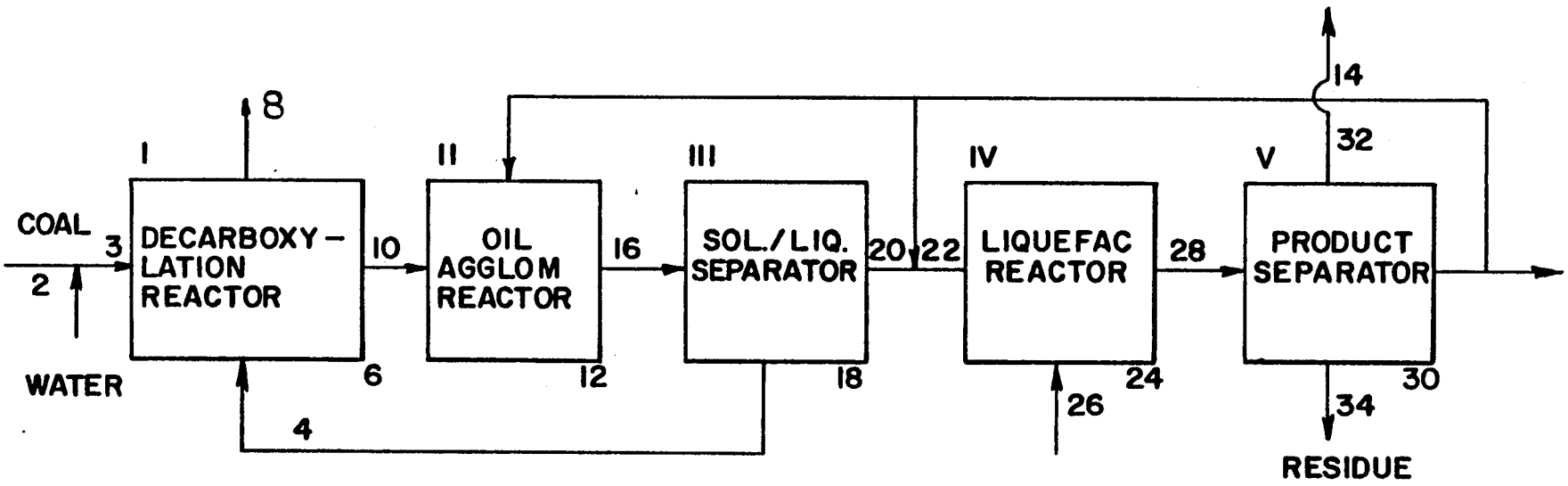
FIG. 1 is a schematic flow sheet depicting a process of the present invention.

In the present invention, a composition consisting essentially of a carbonaceous solid containing at least one carboxyl group is heated with subcritical liquid water under certain decarboxylation temperatures to substantially decarboxylate said solid. After separating a decarboxylated carbonaceous solid from the water, the solid is liquefied.

Carbonaceous solids suitable for use in the present invention include, but are not limited to, coal, tar sand, and oil shale. The preferred hydrocarbon-containing solid is a low-rank coal such as a sub-bituminous coal, brown coal, lignite or peat. Examples of sub-bituminous coals are the Powder River sub-bituminous coals from Wyodak, Black Thunder, and Rawhide mines in Wyoming, Rosebud coal from Montana, and Wildcat coal from Texas. Examples of brown coals are Rhine brown coal (Rheinbraunkohle) from Germany and Victoria brown coal from Australia. Examples of lignites are the Kinneman Creek, Beulah, and Hagel lignites from North Dakota, and the Darco and Big Brown lignites from Texas. Examples of peats include those of Ireland and Scotland. Other humic solids, such as wood, wood chips, and bagasse can also be suitable carbonaceous solids. For convenience, the carbonaceous solid will hereinafter be referred to as coal.

Subcritical liquid water is defined for the purposes of this invention as water having greater than about 50 mole percent in the liquid state, preferably greater than about 75 mole percent, most preferably greater than about 85 mole percent, at a temperature of about 300°-705° F., preferably about 615°-665° F., and at a pressure of about 300-3000 psig, preferably about 750-2450 psig. If the temperature is too high, undesirable retrograde reactions, such as ketone formation, can occur, thereby having a detrimental effect on subsequent liquefaction of the coal. If the temperature is too low, the rate of decarboxylation can be low, thereby necessitating an impractically large coal liquefaction reactor. The pressure should generally be maintained at least about 10-70 psig, preferably 45-55 psig above the saturation vapor pressure of the water. A preferred method of decarboxylating the coal in a manner suitable for use in the present invention can be found in U.S. Pat. No. 4,579,562 which is herein incorporated by reference.

In a preferred embodiment, the decarboxylation step is carried out in the presence of sulfurous acid. The amount of sulfurous acid present can be an amount sufficient to consume a substantial amount of the alkaline earth metal and alkali present in the feed coal. For example, for Wyodak sub-bituminous coals from Wyoming a suitable sulfurous acid concentration can be about 5–7 wt % based on the weight of the coal. For a lignite a suitable concentration of sulfurous acid can be 8–10 wt % based on the weight of the coal. The function of the sulfurous acid is to convert the alkali and alkaline earth metals into water soluble bisulfite salts which can be removed from coal prior to liquefaction. Removal of these cations is necessary to (1) prevent scale formation which can plug up process equipment and (2) to avoid deactivation of liquefaction catalyst. Use of sulfurous acid at the high decarboxylation temperatures used in this invention increases the rate of minerals removal, thereby reducing the liquefaction reactor size. The use of sulfurous acid in the decarboxylation step of the present invention enables simultaneous decarboxylation and demineralization, thereby avoiding the use of multiple reactors.

Substantial decarboxylation is defined for the purpose of this invention as a reduction in coal carboxyl group content of greater than about 40 percent, preferably greater than about 50 percent, most preferably greater than about 70 percent. The extent of decarboxylation can be monitored by, for example, methylation with iodomethane in the presence of tetra-n-butylammonium hydroxide, followed by 13-C NMR determination of the resulting methyl esters.

The presence of added hydrogen sources during decarboxylation of the coal can promote undesirable retrograde reactions, such as ketone formation. Accordingly, in the present invention decarboxylation occurs in the absence of any added hydrogen sources. Added hydrogen source is defined for the purpose of the present invention as hydrogen gas, hydrogen donor solvents that contain hydroaromatic ring structures, or any compounds capable of reacting with water to form hydrogen, for example, carbon monoxide. Such added hydrogen sources do not include any hydrogen source that is indigenous to the coal. Sulfurous acid is not intended to be an added hydrogen source.

The decarboxylation step produces a stream comprising a decarboxylated coal and water. An essential feature of the present invention is separating a substantial portion of the water from the decarboxylated coal. "Substantial" is defined as greater than 50 wt % based on the weight of the coal, preferably greater than 75 wt %, most preferably greater than 85 wt %. Suitable methods of separating the water from the decarboxylated coal stream include, but are not limited to, gravity sedimentation, magnetic separation, filtration, and centrifugation.

In a preferred embodiment, the separation of water from the decarboxylated coal occurs while cleaning the coal to remove dispersed minerals contained within the coal and not effectively removed in the decarboxylation step. Suitable methods of cleaning the coal can include, but are not limited to, gravity, flotation, magnetic, and electrical methods.

A preferred coal cleaning method is oil agglomeration. In the oil agglomeration step for the present invention, the decarboxylated coal stream is contacted with an organic liquid to form a two-phase mixture comprising an organic phase comprising solid coal agglomerates having organic liquid occluded therein and a mineral-rich aqueous phase. Suitable organic liquids include, but are not limited to, an aliphatic solvent, petroleum, lubricating oils, fuel oil, and coal-derived oil. A preferred organic liquid is a coal-derived liquid produced by the process of the present invention. Process conditions suitable for use in the oil agglomeration step of the present invention can be any suitable conditions that agglomerate coal particles. Examples of such conditions can be found in U.S. Pat. No. 4,326,855 herein incorporated by reference. The exact process conditions will depend upon the nature of the coal, the size of the coal particles, and the decarboxylation conditions.

Liquefaction of the separated decarboxylated coal is an essential feature of the present invention. Liquefaction is defined for the purpose of the invention as converting coal into products that are extractable or distillable. Suitable organic solvents useful in the liquefaction stage of the present invention include, but are not limited to, toluene, xylenes, ethylbenzene, methyl-naphthalene, methanol, ethanol, phenol, cresols, naphtha, kerosene, decanted oils, other petroleum derived liquids, and mixtures of such solvents.

A preferred liquefaction method is hydroliquefaction, which involves heating the coal with a hydrogen donor solvent, hydrogen, and optionally, a catalyst. Suitable hydrogen donor solvents include, but are not limited to, tetralin, 9,10-dihydroanthracene, 9,10-dihydrophenanthrene, tetrahydrofluoranthene, hydrogenated creosote oil, hydrogenated anthracene oil, and hydrogenated coal liquid streams.

Forms of liquefaction suitable for use in the present invention include, but are not limited to, thermal, catalytic, retorting, and coprocessing (coal and tar sand or oil shale), or any combination thereof. Suitable liquefaction conditions include, but are not limited to a temperature of about 572°–896° F., a pressure of about 2000–2500 psig, a coal residence time of about 10–24 minutes, and a solvent to coal mass ratio of about 0.5:1 to about 10:1.

In a preferred embodiment, the coal liquefaction step of the present invention can be accomplished in a single stage reactor. As a result of the pretreatment steps described herein, namely removal of organically bound minerals by decarboxylation in the absence of an added hydrogen source, removal of alkali and alkaline earth metals by contacting the coal with a sulfurous acid solution, and removal of dispersed minerals by oil agglomeration, the quality of the liquefaction feed is such that only a singlestate reactor will be required. In this embodiment, the mineral content of the coal liquefaction feed is preferably less than 2%.

FIG. 1 shows a preferred coal hydroliquifaction process. The process is divided up into five separate stages for clarity. Stage I is the decarboxylation stage. In Stage I, coal enters a decarboxylation reactor 6 in stream 2 at an ash content of about 4–10 wt. % and a moisture content of about 15–40 wt. %. The coal is a low rank coal having a carboxyl group content of about 10 wt. % and a particle size of less than about 100 microns. The coal is introduced into reactor 6 as a 50 wt. % water slurry 3. The coal slurry 3 is preheated to about 675° F. High pressure recycle water enters the reactor 6 in stream 4 at a rate approximately equal to the flow rate of the coal water slurry in stream 3. In the reactor 6, the temperature is about 650° F. and the pressure is about 2250 psig. Product gases which are generated during the decarboxylation treatment, primarily carbon dioxide, are removed at or near the top of reactor 6 in stream 8. Removal of product gases can be regulated by a product control valve that maintains the desired pressure in reactor 6. A decarboxylated coal stream having a carboxyl group content of less than about 2.5 wt. % exits the reactor in stream 10.

In Stage II, the decarboxylated coal stream 10 enters an oil agglomeration vessel 12 where it is contacted with a coal-derived liquid stream 14 to form a two phase mixture comprising an organic phase and an aqueous phase. The organic phase comprises solid coal agglomerates having organic liquid occluded therein. The aqueous phase comprises water having minerals dispersed therein. The coal-derived liquid is introduced into the vessel 12 at an amount of about 5% based on the weight of the coal. Process conditions in vessel 12 include a temperature of about 300° F. and a pressure of about 2200 psig. Exiting the vessel 12 in stream 16 is the two phase liquid referred to above.

In Stage III, the two phase mixture 16 enters a solid-liquid separator 18 where the aqueous phase is separated from the organic phase using, for example, a screen. The aqueous phase exits the separator 18 in stream 4 and is recycled back to the decarboxylation reactor 6. The organic phase exits the separator 18 in stream 20.

Prior to entering Stage IV, where liquefaction occurs, the organic phase is mixed with additional coal-derived liquid to form a coal-oil slurry which enters the liquefaction reactor 24 in stream 22. Hydrogen gas enters the liquefaction reactor 24 in stream 26 at a pressure of about 2800 psig. Other liquefaction conditions include a temperature of about 800° F. and a coal residence time of about 60 minutes. The liquefaction product exits the liquefaction reactor 24 in stream 28.

In Stage V, the liquefaction product 28 enters the product separator 30 where light gases are separated from the coal derived liquid. The light gases exit the product separator 30 in stream 32. The coal-derived liquid exits the product separator 30 in stream 14. Also exiting the separator 30 is a residue stream 34 containing unconverted coal, ash, and high boiling products.

EXAMPLES

The following examples can be separated into three groups. Examples 1–10 deal with noncatalytic decarboxylation of low rank coal prior to liquefaction. A summary of these results is shown in Table I. Examples 11–16 deal with catalytic decarboxylation of low rank coal prior to liquefaction. A summary of these results is shown in Table II. Examples 17–18 deal with noncatalytic decarboxylation low rank in the presence of sulfurous acid prior to liquefaction.

To protect the coal from possible oxidation (weathering), manipulations of the coal were carried out, insofar as possible, under an inert atmosphere of nitrogen or vacuum. For convenience, we hereinafter refer to coal conversion on a dmmf basis to products soluble in tetrahydrofuran as "coal conversion", and to yield on a dmmf basis of hexane soluble oils as "oil yield." For brevity in both cases, unless otherwise specified, the term "percent" is hereinafter used to denote "weight percent on the basis of dmmf starting coal."

EXAMPLE 1

A sample of Wyodak sub-bituminous coal (Powder River Basin, Wyoming) was ground to −325 mesh, and dried under vacuum at 140° F. for 24 hours. The dried coal contained 5.03 weight percent ash. An 8-gram aliquot of the dried coal and 16 grams of tetralin donor solvent (2:1 solvent:coal) were charged to a reactor, which was then sealed and charged with 500 psig of hydrogen gas. The coal was liquefied by heating the reactor at 752° F. for 30 minutes. Coal conversion to products soluble in tetrahydrofuran (THF) was 70.9 weight percent on a dry mineral matter free (dmmf) basis. The yield of hexane soluble oils, the most desirable product fraction, was 22.0 weight percent (dmmf).

EXAMPLE 2

A sample of Wyodak coal was ground to −325 mesh. This coal contained 26.60 weight percent water. As in Example 1, the ash content of this coal was 5.03 weight percent on a dry coal basis (3.69 weight percent on as-received coal basis). An 8-gram aliquot of the wet Wyodak coal and 16 grams of water were charged to a reactor, which was then sealed and charged with 500 psig of nitrogen gas. The coal was decarboxylated by heating at 617° F. for 60 minutes, after which the decarboxylated coal was filtered from the water phase. Carbon dioxide rejection was 8.05 percent, 78% of the amount expected based upon carboxyl group analysis of this coal (78% of the theoretical amount). A 5-gram aliquot of the decarboxylated coal was liquefied in 10 grams of tetralin (2:1 solvent:coal) under the conditions of Example 1. Coal conversion was 77.1 percent, and the oil yield was 34.5 percent. This example shows that substantially decarboxylating the coal in liquid water in the absence of an added hydrogen source prior to liquefaction enhances oil yield.

EXAMPLE 3

An 8-gram aliquot of the dried Wyodak coal used in Example 1 was placed in a reactor, which was then sealed and charged with 500 psig of nitrogen gas. The coal was decarboxylated by heating at 617° F. for 60 minutes to reject 2.98 percent carbon dioxide (29% of theoretical amount). A 5-gram aliquot of the decarboxylated coal was liquefied in 10 grams of tetralin under conditions of Example 1. Coal conversion was 70.7 percent, and oil yield was 23.8 percent. This example illustrates the detrimental effect of drying on both carbon dioxide rejection, and the oil yield obtained upon liquefaction of the pretreated coal.

EXAMPLE 4

An 8-gram aliquot of the wet Wyodak coal used in Example 1 and 16 grams of water were charged to a reactor, which was then sealed and charged with 500 psig of hydrogen gas as an added hydrogen source. The coal was decarboxylated by heating at 617° F. for 60 minutes, after which the decarboxylated coal was filtered from the water phase. Carbon dioxide rejection was 6.75 percent (65% of theoretical amount). A 5-gram aliquot of the decarboxylated coal was liquefied under the conditions of Example 1. Coal conversion was 72.0 percent, and the oil yield was 24.5 percent. This example shows that having hydrogen gas present during the pretreatment has a detrimental effect on both carbon dioxide rejection and oil yield upon liquefaction of the pretreated coal.

EXAMPLE 5

An 8-gram aliquot of the wet Wyodak coal used in Example 2 and 16 grams of water were charged to a reactor, which was then sealed and charged with 500 psig of nitrogen gas. The coal was decarboxylated by heating at 572° F. for 30 minutes, after which the decarboxylated coal was filtered from the water phase. Carbon dioxide rejection was 4.48 percent (43% of the theoretical amount). A 5-gram aliquot of the decarboxylated coal was liquefied under the conditions of Example 1. Coal conversion was 72.0 percent, and the oil yield was 27.6 percent. This example shows that decarboxylation of the coal at 572° F. for 30 minutes leads, upon liquefaction of the decarboxylated coal, to lower carbon dioxide rejection, and oil yield than are obtained if the pretreatment is carried out under the preferred pretreatment conditions described in Example 2.

EXAMPLE 6

An 8-gram aliquot of the wet Wyodak coal used in Example 2 and 16 grams of tetralin donor solvent as an added hydrogen source were charged to a reactor, which was then sealed and charged with 500 psig of nitrogen gas. The coal was decarboxylated by heating at 572° F. for 30 minutes, after which the decarboxylated coal was filtered from the tetralin. Carbon dioxide rejection was 3.47 percent (34% of theoretical amount). A 2-gram aliquot of the pretreated coal was then liquefied in 4 grams of tetralin under conditions of Example 1. Overall coal conversion was 72.5 percent, and overall oil yield was 29.1 percent. This example illustrates the detrimental effect on both carbon dioxide rejection and oil yield of having a hydrogen donor solvent present during the decarboxylation step.

EXAMPLE 7

An 8-gram aliquot of the wet Wyodak coal used in Example 2 and 16 grams of tetralin donor solvent as an added hydrogen source were charged to a reactor, which was then sealed and charged with 500 psig of hydrogen gas. The coal was decarboxylated by heating at 572° F. for 30 minutes, after which the decarboxylated coal was filtered from the tetralin. Carbon dioxide rejection was 2.83 percent (27% of theoretical amount). A 2-gram aliquot of the pretreated coal was then liquefied in 4 grams of tetralin under conditions of Example 1. Overall coal conversion was 73.0 percent, and overall oil yield was 27.7 percent. This example further illustrates the detrimental effect on oil yield obtained when added hydrogen sources are present during the decarboxylation pretreatment.

Taken together, Examples 4, 6, and 7 show that the presence of added hydrogen sources during the decarboxylation pretreatment has an unexpected detrimental effect on the oil yield obtained from liquefaction of the decarboxylated coal.

EXAMPLE 8

An 8-gram aliquot of the wet Wyodak coal used in Example 2 and 16 grams of water were charged to a reactor, which was then sealed and charged with 500 psig of nitrogen gas. The coal was decarboxylated by heating at 527° F. for 60 minutes, after which the decarboxylated coal was filtered from the water phase. Carbon dioxide rejection was 3.04 percent (29% of the theoretical amount). A 5-gram aliquot of the decarboxylated coal was liquefied under the conditions of Example 1. Coal conversion was 76.1 percent, and the oil yield was 30.9 percent. This example shows that decarboxylation of the coal at 527° F. leads, upon liquefaction of the decarboxylated coal, to an oil yield that is less than that obtained if the pretreatment is carried out under the preferred pretreatment conditions described in Example 2.

EXAMPLE 9

An 8-gram aliquot of the wet Wyodak coal used in Example 2 and 16 grams of water were charged to a reactor, which was then sealed and charged with 500 psig of nitrogen gas. The coal was decarboxylated by heating at 617° F. for 15 minutes, after which the decarboxylated coal was filtered from the water phase. Carbon dioxide rejection was 4.17 percent (40% of the theoretical amount). A 5-gram aliquot of the decarboxylated coal was liquefied under the conditions of Example 1. Coal conversion was 71.4 percent, and the oil yield was 27.4 percent. This example shows that decarboxylation of the coal at 617° F. for 15 minutes instead of 60 results in less carbon dioxide rejection and a lower oil yield than that obtained if the pretreatment is carried out under the preferred pretreatment conditions described in Example 2. However, both carbon dioxide rejection and oil yield are higher than those obtained by conventional liquefaction of Wyodak coal. (Example 1).

EXAMPLE 10

An 8-gram aliquot of the wet Wyodak coal used in Example 2 was charged to a reactor, which was then sealed and charged with 500 psig of nitrogen gas. The coal was decarboxylated by heating at 617° F. for 60 minutes, after which the decarboxylated coal was filtered from the small amount of water phase. Carbon dioxide rejection was 7.12 percent (69% of the theoretical amount). A 5-gram aliquot of the decarboxylated coal was liquefied under the conditions of Example 1. Based on starting dmmf coal, the coal conversion was only 63.1 weight percent, and the oil yield was only 23.3 percent. This example shows that decarboxylation in the absence of added liquid water leads, upon liquefaction of the decarboxylated coal, to an oil yield that is substantially less than that obtained if the decarboxylation pretreatment is carried out as described in Example 2. In the absence of added water, carbon dioxide rejection was lowered from 78% to 69% of the theoretical amount.

TABLE I

Decarboxylation of Wyodak Coal and Liquefaction of the Pretreated Coal

| | Decarboxylation | | | | Liquefaction of the Decarboxylate Coal,[b] wt % (dmmf) | |
|---|---|---|---|---|---|---|
| Ex. ample | Temp., °C. | Time, min. | Atmos-phere | $CO_2$ Yield[a], % of Theor. | Conversion | Oil Yield |
| 1 | — | — | — | — | 70.9 | 22 |
| 2 | 325 | 60 | $N_2$ | 78 | 77.1 | 34.5 |
| 3 | 325 | 60 | $N_2$ | 29 | 70.7 | 23.8 |
| 4 | 325 | 60 | $H_2$ | 65 | 72 | 24.5 |
| 5 | 300 | 30 | $N_2$ | 43 | 72 | 27.6 |
| 6 | 300 | 30 | $N_2$ | 34 | 72.5 | 29.1 |
| 7 | 300 | 30 | $H_2$ | 27 | 73 | 27.7 |
| 8 | 275 | 15 | $N_2$ | 29 | 76.1 | 30.9 |
| 9 | 325 | 60 | $N_2$ | 40 | 71.4 | 27.4 |
| 10 | 325 | 60 | $N_2$ | 69 | 63.1 | 23.3 |

[a]Yields are based upon the carboxyl group content of the starting coal, as determined by esterification using 13-C labelled iodomethane followed by solid-state nmr spectroscopy and combustion-MS analyses.

[b]All liquefactions were carried out in tubing microreactors under the following conditions: Tetralin: Coal = 2:1; 400° C.; 30 minutes; $H_2$, 500 psig (cold). The liquefaction products were separated into the following fractions: gases, oils (hexane-soluble), asphaltenes (hexane-insoluble, toluene-soluble), preasphaltenes (toluene-insoluble, tetrahydrofuran-soluble, and residue (tetrahydrofuran-insoluble). The reported coversions and oil yields are based upon the dry, mineral matter-free (dmmf) starting coal.

EXAMPLE 11

A sample of Wyodak sub-bituminous coal (Powder River Basin, Wyoming) was ground to −325 mesh, and dried under vacuum at 140° F. for 24 hours. The dried coal contained 5.03 weight percent ash. An 8-gram aliquot of the dried coal and 16 grams of tetralin donor solvent (2:1 solvent:coal) were charged to a reactor, which was then sealed and charged with 500 psig of hydrogen gas. The coal was liquefied by heating the reactor at 752° F. for 30 minutes. Coal conversion to products soluble in tetrahydrofuran (THF) was 70.9 weight percent on a dry mineral matter-free (dmmf) basis. The yield of hexane soluble oils, the most desirable production fraction, was 22.0 weight per cent (dmmf).

EXAMPLE 12

A sample of Wyodak coal was ground to −325 mesh. This coal contained 26.60 weight percent water. As in Example 1, the ash content of this coal was 5.03 weight percent on a dry coal basis (3.69 weight percent on as-received coal basis). An 8-gram aliquot of the wet Wyodak coal and 16 grams of water were charged to a reactor, which was then sealed and charged with 500 psig of nitrogen gas. The coal was decarboxylated by heating at 617° F. for 15 minutes, after which the decarboxylated coal was filtered from the water phase. Carbon dioxide rejection was 8.05 percent, 78% of the amount expected based upon carboxyl group analysis of this coal (78% of the theoretical amount). A 5-gram aliquot of the decarboxylated coal was liquefied in 10 grams of tetralin (2:1 solvent:coal) under the conditions of Example 1. Coal conversion was 77.1 percent, and the oil yield was 34.5 percent. This example illustrates the enhanced decarboxylation and oil yield upon liquefaction of the pretreated coal that can be obtained by decarboxylative pretreatment of the coal in liquid water, and in the absence of added hydrogen sources, before liquefaction.

EXAMPLE 13

As in Example 12, this coal contained 26.60 weight percent water, and 5.03 weight percent ash on a dry coal basis (3.69 weight percent as-received coal basis).

A copper catalyst, nominally copper (I) carbonate, was impregnated into the coal using the procedure of Stournas et al. (Fuel Proc. Technol. 1987, 17, 195–200), as follows: In a N-flushed glove box, a 250-ml Erlenmeyer flask was charged with 0.80 g of copper (I) chloride (8 mmol, Aldrich, contained 0.50 g of Cu), 100 ml of deoxygenated water and a magnetic stirring bar. The contents were stirred to dissolve the salt. A 100-ml Erlenmeyer was charged with 1.10 g (8 mmoles) of sodium carbonate, 40 ml of deoxygenated water and a magnetic stirring bar. The contents were stirred to dissolve the salt. To the stirred CuCl solution was added 50 g of coal; the mixture was stirred for 2 hours to allow ion exchange to occur. The sodium carbonate solution was added and the resulting mixture was stirred for 30 minutes to neutralize the HCl liberated by ion exchange. The Cu-loaded coal was isolated by vacuum filtration, being careful not to filter to dryness. The product should contain copper (I) salts of carboxylic acids in the coal, plus some $Cu_2CO_3$. An aliquot of the damp product was dried at 60° under vacuum to obtain its moisture content, and the dry residue was analyzed to verify its copper content.

An 8-gram aliquot of the copper-loaded Wyodak coal and 16 grams of water were charged to a reactor, which was then sealed and charged with 500 psig of nitrogen gas. The coal was decarboxylated by heating at 617° F. for 15 minutes, after which the decarboxylated coal was filtered from the water phase. Carbon dioxide rejection was 5.76 percent (56% of the theoretical amount), measured as the free $CO_2$ in the gas product. It should be noted that this value is a lower bound on the extent of carbon oxide rejection. Treatment of the coal with sodium carbonate will result in ion exchange reactions that neutralize acidic groups in the coal, and convert them into basic groups with the release of some $CO_2$. Decarboxylation of the catalyst-loaded coal will liberate the exchanged base, and this base will react with some of the produced $CO_2$ as the decarboxylation reactor cools. The extent of coal ion exchange with base was not determined, nor was the oxygen content of the decarboxylated coal determined directly. Therefore, quantification of the amount of $CO_2$ that reacts with liberated base cannot be calculated from the available data.

A 5-gram aliquot of the decarboxylated coal was liquefied in 10 grams of tetralin (2:1 solvent:coal) under the conditions of Example 1. Coal conversion was 73.3 percent, and the oil yield was 36.6 percent. This example shows that substantial decarboxylation can be obtained in the presence of the catalyst, and that subsequent liquefaction of the coal pretreated in the presence of the catalyst affords a substantially enhanced oil yield relative to liquefaction of raw coal (22.0 percent oil) or to liquefaction of coal decarboxylated in the absence of the catalyst (34.6 percent oil.). Thus, there is a significant benefit to decarboxylation of the coal in the presence of the copper catalyst before liquefaction of the pretreated coal.

EXAMPLE 14

An 8-gram aliquot of the copper-loaded Wyodak coal used in Example 13 and 16 grams of water were placed in a reactor, which was then sealed and charged with 500 psig of hydrogen gas. The coal was decarboxylated by heating at 527° F. for 15 minutes to reject 2.00 percent carbon dioxide (19% of theoretical amount). This example shows that 15 minutes at 527° F. is not sufficient to achieve more than 50% decarboxylation of the coal, even in the presence of the copper catalyst.

EXAMPLE 15

An 8-gram aliquot of the copper-loaded Wyodak coal used in Example 13 and 16 grams of water were placed in a reactor, which was then sealed and charged with 500 psig of nitrogen gas. The coal was decarboxylated by heating at 572° F. for 30 minutes to reject 4.82 percent carbon dioxide (47% of theoretical amount). This example shows that 30 minutes at 572° F. is not sufficient to achieve more than 50% decarboxylation of the coal.

EXAMPLE 16

An 8-gram aliquot of the copper-loaded Wyodak coal used in Example 13 and 16 grams of water were placed in a reactor, which was then sealed and charged with 500 psig of nitrogen gas. The coal was decarboxylated by heating at 572° F. for 60 minutes to reject 9.29 percent carbon dioxide (90% of theoretical amount). This result shows that nearly quantitative decarboxylation of the coal can be obtained under these conditions.

A 5-gram aliquot of the decarboxylated coal was liquefied in 10 grams of tetralin (2:1 solvent:coal) under the conditions of Example 1. Coal conversion was 64.2 percent, and the oil yield was 23.0 percent. This conversion and oil yield are substantially lower than the 73.3 percent conversion and 36.6 percent oil yield obtained from the coal that was decarboxylated using the preferred pretreatment conditions of Example 13. Thus, there is an optimum window of time and temperature for practice of the catalyzed pretreatment process; heating for too long at 617° F. in the pretreatment can lower the oil yield obtained upon subsequent liquefaction of the decarboxylated coal.

TABLE II

Copper-Catalyzed Decarboxylation of Wyodak Coal and Liquefaction of the Pretreated Coal

| | Decarboxylation | | | | | Liquefaction of the Carboxylated Coal,[b] wt % (dmmf) | |
|---|---|---|---|---|---|---|---|
| Example | Copper Catalyst | Temp., °C. | Time, min. | Atmosphere | $CO_2$ Yield[a], % of Theor. | Conversion | Oil Yield |
| 1 | — | — | — | — | — | 70.9 | 22.0 |
| 2 | No | 325 | 15 | $N_2$ | 78 | 77.1 | 34.5 |
| 3 | Yes | 325 | 15 | $N_2$ | 56 | 73.3 | 36.6 |
| 4 | Yes | 275 | 15 | $H_2$ | 19 | — | — |
| 5 | Yes | 300 | 30 | $N_2$ | 47 | — | — |
| 6 | Yes | 325 | 60 | $N_2$ | 90 | 64.2 | 23.0 |

[a]Yields are based upon the carboxyl group content of the starting coal, as determined by esterification using 13-C labelled iodomethane followed by solid-state nmr spectroscopy and combustion-MS analyses.
[b]All liquefactions were carried out in tubing microreactors under the following conditions: Tetralin: Coal = 2:1; 400° C.; 30 minutes; $H_2$, 500 psig (cold). The liquefaction products were separated into the following fractions: gases, oils (hexane-soluble), asphaltenes (hexane-insoluble, toluene-soluble), preasphaltenes (toluene-insoluble, tetrahydrofuran-soluble, and residue (tetrahydrofuran-insoluble).
The reported coversions and oil yields are based upon the dry, mineral matter-free (dmmf) starting coal.

EXAMPLE 17

A 5 g aliquot of the coal sample used in Example 1, which contains 5.03 wt % mineral matter, was mixed with 20 g of tetralin and an initial charge of 500 psig hydrogen gas ands liquefied in a 300 cc Hasteloy C autoclave at 752° F. for 30 minutes. Coal conversion to products soluble in tetrahydrofuran (THF) on a dry mineral matter free (dmmf) basis was 69 weight percent. The yield of hexane soluble oils was 40 weight percent (dmmf).

EXAMPLE 18

A 10 g aliquot of the coal sample used in Example 1 was mixed with 20 g of a 2 percent aqueous solution of sulfur dioxide in a 300 cc Hasteloy C autoclave and an initial nitrogen pressure of 100 psig and heated at 572° F. for 30 minutes. The resulting coal was separated from the water by filtration and washed with distilled water until free of acid. The mineral matter content of the treated coal was 2.6 weight percent compared to 5.03 weight percent for the starting coal In addition, the carboxyl content of the treated coal was reduced by 66 weight percent compared to the starting coal. A 5 g aliquot of the treated coal was mixed with 20 g of tetralin and an initial charge of 500 psig hydrogen gas an liquefied in as 300 cc Hasteloy C autoclave at 752° F. for 30 minutes. Coal conversion to products soluble in tetrahydrofuran (THF) on a dry mineral matter free (dmmf) basis was 77 weight percent. The yield of hexane soluble oils was 43 weight percent (dmmf).

That which is claimed is:

1. A liquefaction process, comprising the steps of:
(a) heating a composition consisting essentially of a carbonaceous solid containing at least one carboxyl group with subcritical liquid water to a temperature between about 300° and 705° F. at a pressure between about 300 and 3000 psig to substantially decarboxylate said solid thereby producing a stream comprising a decarboxylated carbonaceous solid and water;
(b) separating a substantial portion of said water from said decarboxylated carbonaceous solid; and
(c) liquefying said decarboxylated carbonaceous solid to produce a hydrocarbon-containing liquid.

2. A process of claim 1 wherein said carbonaceous solid comprises coal.

3. A process of claim 1 wherein step (a) is carried out in the presence of sulfurous acid.

4. A process of claim 1 wherein step (b) is contacting said stream with an organic liquid to form a two phase mixture comprising an organic phase comprising carbonaceous solid agglomerates and a mineral-rich aqueous phase and separating said organic phase from said aqueous phase to produce a decarboxylated, demineralized carbonaceous solid, and wherein step (c) is liquefying said decarboxylated, demineralized carbonaceous solid to produce a hydrocarbon-containing liquid.

5. A process of claim 4 wherein a portion of the hydrocarbon containing liquid is recycled back to step (b) to serve as the organic liquid.

6. A process of claim 5 wherein a portion of the hydrocarbon containing liquid is recycled back to step (c) to liquefy the decarboxylated, demineralized carbonaceous solid.

7. A process of claim 1 wherein liquefaction occurs in the presence of a hydrogen source.

8. A process of claim 1 wherein in step (a) greater than about 75 mole percent of said water is in a liquid state.

9. A process of claim 8 wherein in step (a) greater than about 85 mole percent of said water is in said liquid state.

10. A process of claim 1 wherein in step (a) carboxyl group content of said carbonaceous solid is reduced by greater than about 50 percent.

11. A process of claim 10 wherein said carboxyl group content is reduced by greater than about 70 percent.

12. A process of claim 1 wherein step (a) is carried out in the presence of a copper catalyst.

13. A process of claim 12 wherein wherein said catalyst was impregnated onto said carbonaceous solid prior to step (a).

14. A process of claim 13 wherein said catalyst comprises CuCl.

15. A liquefaction process, comprising the steps of:

(a) heating a composition consisting essentially of a coal containing at least one carboxyl group with subcritical liquid water to a temperature between about 300° and 705° F. at a pressure between about 300 and 3000 psig to substantially decarboxylate said coal thereby producing a stream comprising decarboxylated coal and water;

(b) agglomerating said stream by contacting said stream with an organic liquid to form a two-phase mixture comprising an organic phase comprising solid coal agglomerates and a mineral-rich aqueous phase, and separating said organic phase from said aqueous phase, thereby producing a decarboxylated, demineralized coal; and (c) hydroliquefying said decarboxylated, demineralized coal to produce a coal-derived liquid.

16. A process of claim 15 wherein in step (a) greater than about 75 mole percent of said water is in a liquid state.

17. A process of claim 16 wherein in step (a) greater than about 85 mole percent of said water is in a liquid state.

18. A process of claim 17 wherein in step (a) said carboxyl group content is reduced by greater than about 50 percent.

19. A process of claim 18 wherein said carboxyl group content is greater than 70 percent.

20. A process of claim 15 wherein step (a) occurs in the presence of a copper catalyst.

21. A process of claim 20 wherein said catalyst was impregnated onto said coal prior to step (a).

22. A process of claim 21 wherein said catalyst comprises CuCl.

23. A process of claim 15 wherein a portion of the coal-derived liquid is recycled back to step (b) to serve as the organic liquid.

24. A process of claim 15 wherein a portion of the coal-derived liquid is recycled back to step (c) to liquefy the decarboxylated, demineralized coal.

25. A coal agglomeration process, comprising the steps of:

(a) heating a composition consisting essentially of coal containing at least one carboxyl group with subcritical liquid water at conditions sufficient to substantially decarboxylate said coal including a temperature of at least about 300° F. in the presence of a copper catalyst, thereby producing a decarboxylated coal stream;

(b) agglomerating said decarboxylated coal stream by contacting said decarboxylated stream with a coal-derived liquid to form a two-phase mixture comprising an organic phase comprising coal agglomerates and a mineral-rich aqueous phase, and separating said organic phase from said aqueous phase, thereby producing decarboxylated, demineralized coal;

(c) hydroliquefying said decarboxylated, demineralized coal to produce a coal-derived liquid; and (d) recycling a portion of said coal-derived liquid to step (b).

26. A process of claim 25 wherein a portion of said coal-derived liquid is recycled back to step (c) to liquefy said decarboxylated, demineralized coal.

27. A coal agglomeration process, comprising the steps of:

(a) heating a composition consisting essentially of coal containing at least one carboxyl group with subcritical liquid water at conditions sufficient to substantially decarboxylate said coal including a temperature of at least about 300° F. in the presence of sulfurous acid, thereby producing a decarboxylated coal stream;

(b) agglomerating said decarboxylated coal stream by contacting said decarboxylated stream with a coal-derived liquid to form a two-phase mixture comprising an organic phase comprising coal agglomerates and a mineral-rich aqueous phase, and separating said organic phase from said aqueous phase, thereby producing decarboxylated, demineralized coal;

(c) hydroliquefying said decarboxylated, demineralized coal to produce a coal-derived liquid; and (d) recycling a portion of said coal-derived liquid to step (b).

* * * * *